US011054205B1

(12) United States Patent
Lipowski

(10) Patent No.: US 11,054,205 B1
(45) Date of Patent: Jul. 6, 2021

(54) TRIGGER DEVICE WITH OVER TRAVEL STOP

(71) Applicant: Mats Lipowski, Mississauga (CA)

(72) Inventor: Mats Lipowski, Mississauga (CA)

(73) Assignee: 2360216 ONTARIO, INC., Ontario (CA)

( * ) Notice: Subject to any disclaimer, the term of this patent is extended or adjusted under 35 U.S.C. 154(b) by 0 days.

(21) Appl. No.: 16/932,652

(22) Filed: Jul. 17, 2020

Related U.S. Application Data

(60) Provisional application No. 62/876,237, filed on Jul. 19, 2019.

(51) Int. Cl.
*F41A 19/16* (2006.01)
*F41A 19/31* (2006.01)

(52) U.S. Cl.
CPC ..... *F41A 19/31* (2013.01); *F41A 19/16* (2013.01)

(58) Field of Classification Search
CPC .... F41A 19/16; F41A 3/22; F41A 3/68; F41A 19/31; F41A 19/17
USPC ..... 42/69.02, 19
See application file for complete search history.

(56) References Cited

U.S. PATENT DOCUMENTS 4,457,094 A * 7/1984 Thompson ..... F41A 19/31 42/16
4,499,684 A * 2/1985 Repa ..... F41A 19/17 42/69.01

* cited by examiner

*Primary Examiner* — Reginald S Tillman, Jr.
(74) *Attorney, Agent, or Firm* — Tarolli, Sundheim, Covell & Tummino LLP

(57) ABSTRACT

A trigger device for a bolt action firearm is disclosed. The trigger device comprises a trigger, a housing, a bolt pin, and a bolt pin arm. The trigger is rotatably coupled in the housing via a trigger pivot pin and comprises a trigger stop arm. The bolt pin is moveable between a bolt open position and a bolt closed position in response to positioning of a bolt. The bolt pin arm is rotatably coupled proximal one end to the housing and at another end to the bolt pin. The bolt pin arm comprises an over travel stop configured to selectively engage with the trigger stop arm. In the bolt closed position, the over travel stop is positioned within a travel path of the trigger stop arm. In the bolt open position, the over travel stop is positioned outside of the travel path of the trigger stop arm.

8 Claims, 6 Drawing Sheets

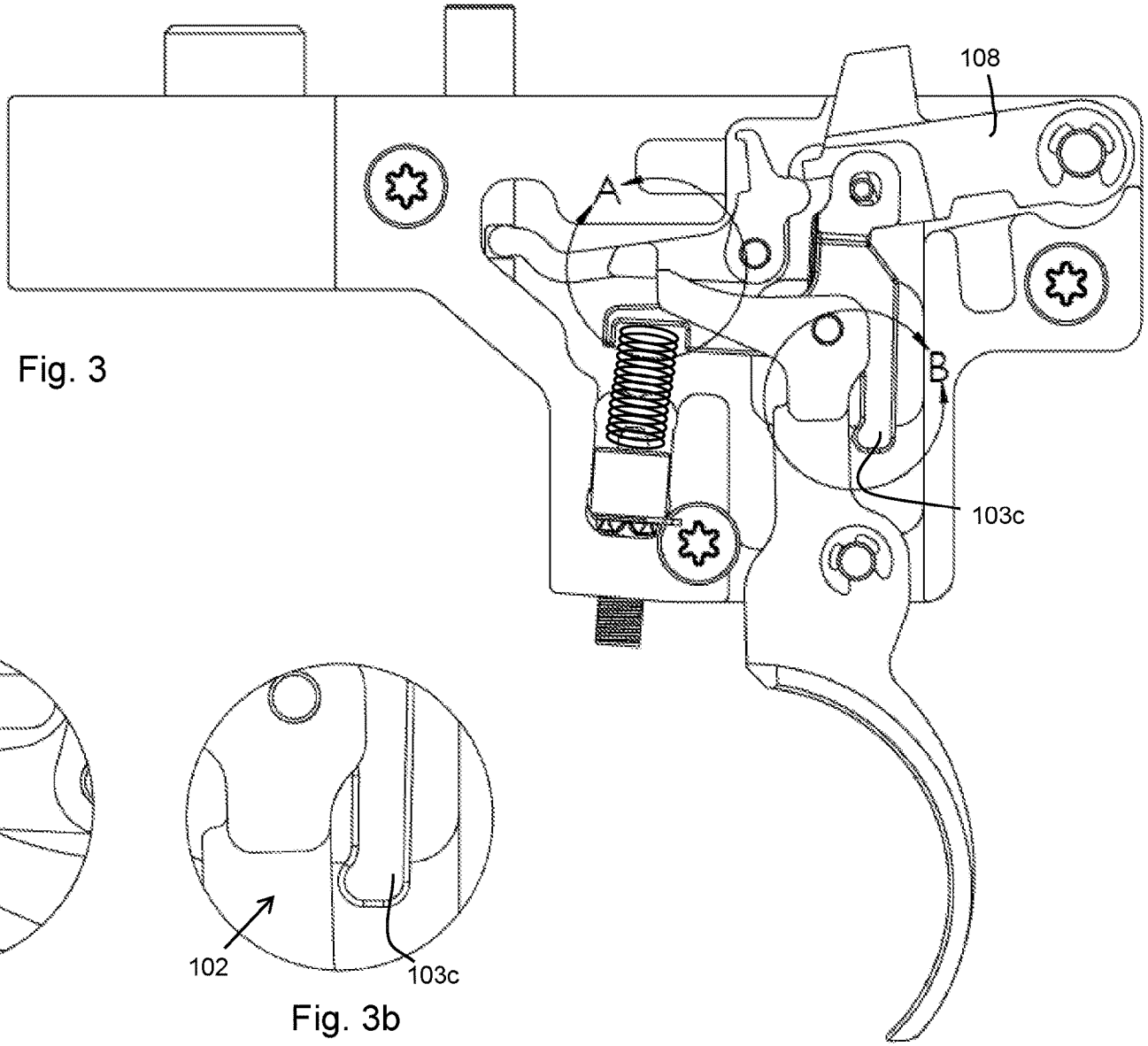
Fig. 3
Fig. 3b
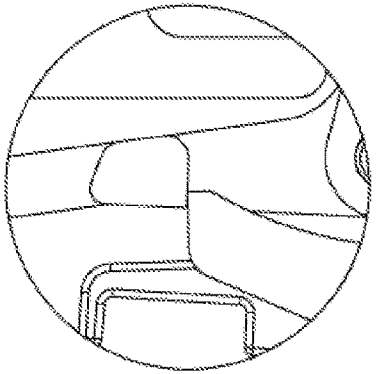
Fig. 3a

TRIGGER DEVICE WITH OVER TRAVEL STOP

The present application relates generally to a trigger device for a bolt-action firearm, and specifically to a trigger device configured to provide a trigger over travel stop in a bolt-action firearm. This application claims priority to U.S. Provisional Application No. 62/876,237 filed Jul. 19, 2019 and titled "Trigger Device with Over Travel Stop," the contents of which are incorporated herein by reference.

BACKGROUND

Bolt action is a type of firearm action where the handling of cartridges into and out of the firearm's barrel chamber is operated by manually manipulating a bolt directly via a handle. When the handle is operated, the bolt is unlocked from the receiver and pulled back to open the breech, allowing the spent cartridge case to be extracted and ejected, the firing pin within the bolt is cocked either on opening or closing of the bolt depending on the gun design, and engages the sear. Then upon the bolt being pushed back a new cartridge is loaded into the chamber. Finally, the breech is closed tight by the bolt locking against the receiver.

Bolt-action firearms are most often rifles, but there are some bolt-action variants of shotguns and a few handguns as well. Examples of this system date as far back as the early 19th century. From the late 19th century, all the way through both World Wars, the bolt-action rifle was the standard infantry firearm for most of the world's military forces. In modern military and law enforcement use, the bolt-action has been mostly replaced by semi-automatic and selective-fire firearms, though the bolt-action design remains popular in dedicated sniper rifles due to inherently more rugged design and are still very popular for civilian hunting and target shooting.

To couple or decouple the bolt from the firearm, a bolt release is provided. In some firearms, the trigger itself is configured to provide the bolt release. A problem with conventional triggers is that they often have a large over travel. Over travel is any amount of additional trigger movement following a trigger break point. Shooters may find a large over travel disruptive. Conventional solutions use set screws to limit trigger over travel. However, when the trigger is used as a bolt release, using set screw to inhibit over travel becomes very complex, if at all possible.

Accordingly, it is an object to provide a trigger device that obviates or mitigates at least some of these disadvantages.

SUMMARY

In accordance with as aspect of an embodiment, there is provided a trigger device comprising: a housing; a trigger rotatably coupled in the housing via a trigger pivot pin, the trigger comprising a trigger stop arm; a bolt pin moveable between a bolt open position and a bolt closed position in response to positioning of a bolt, a bolt pin arm rotatably coupled proximal one end to the housing and at another end to the bolt pin, the bolt pin arm comprising an over travel stop configured to selectively engage with the trigger stop arm; wherein: in the bolt closed position, the over travel stop is positioned within a travel path of the trigger stop arm; and in the bolt open position, the over travel stop is positioned outside of the travel path of the trigger stop arm.

In an embodiment, a ticker is coupled to the trigger. The ticker comprises a cam surface and the bolt pin arm comprises a cam protrusion proximal the one end. The cam protrusion is configured to engage the cam surface. In the bolt open position, the trigger stop arm is configured to bypass the over travel stop, the ticker is configured to rotate the bolt pin arm by engagement of the cam surface with the cam protrusion, and the bolt pin arm is configured to move the bolt pin from the bolt open position to a bolt release position;

In an embodiment, the over travel stop is positioned to inhibit movement of the trigger immediately following a break to provide minimal over travel. Alternatively, the over travel stop is positioned to inhibit movement of the trigger at a point beyond a break to provide an acceptable amount over travel. The ticker is rotatably coupled with the trigger at a ticker pivot pin and configured to rotate about the ticker pivot pin when the trigger stop arm engages the over travel stop.

The trigger stop arm may comprise a trigger stop interface and the over travel stop may be configured to interface with trigger stop interface. The over travel stop may be adjustably coupled to the bolt pin arm to provide a variable over travel distance.

BRIEF DESCRIPTION OF THE DRAWINGS

Embodiments of the description will now be described by way of example only with reference to the following drawings in which:

FIG. 3 is a cross-sectional view of the trigger device in a post-fired configuration;

FIG. 3*a* is an enlarged view illustrating the bolt pin arm missing the trigger;

FIG. 3*b* is an enlarged view illustrating a ticker disengaging from a trigger;

DETAILED DESCRIPTION OF THE PREFERRED EMBODIMENTS

Figure 1:
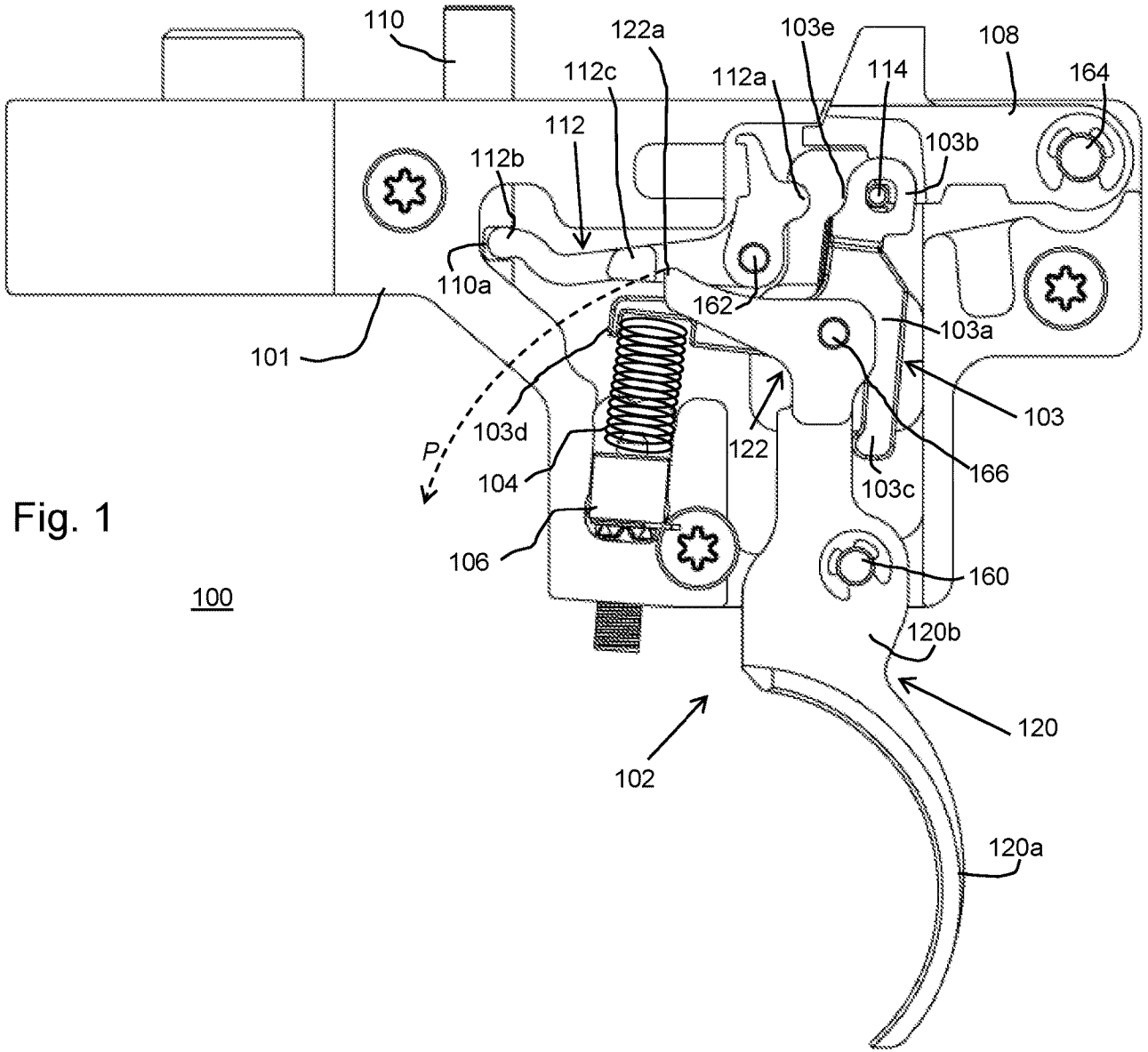
FIG. 1 is a cross-sectional view of a trigger device in a loaded configuration.

For convenience, like numerals in the description refer to like structures in the drawings. Referring to FIGS. 1 to 6, a cross-sectional view of a trigger device in accordance with an aspect of an embodiment is illustrated generally by numeral 100. The trigger device 100 includes a housing 101, a trigger 102, a ticker 103, a trigger biasing spring 104, a trigger pull-weight adjustment mechanism 106, a sear 108, a bolt pin 110, a bolt pin arm 112, and a roller 114.

The trigger 102 comprises an actuation member 120 and a trigger stop arm 122. The actuation member 120 comprises an arcuate portion 120*a* configured to interface with a user's finger and a main body 120*b* configured to rotate about a trigger pivot pin 160. The trigger stop arm 122 is coupled to the main body 120*b* at a distal end from the arcuate portion 120*a*. The trigger stop arm 122 comprises a trigger stop interface 122*a* at a distal end from the main body 120*b*. The trigger stop interface 122*a* is configured to selectively engage with the bolt pin arm 112. As the trigger 102 rotates about the trigger pivot pin 160, the trigger stop interface 122*a* travels in an arcuate path P.

The ticker 103 comprises a main portion 103*a*, a sear-engagement portion 103*b*, a trigger engagement portion 103*c*, and a ticker arm 103*d*. The main portion 103*a* is rotationally coupled to the trigger stop arm 122 about a ticker pivot pin 166. The sear engagement portion 103*b* and the trigger engagement portion 103*c* extend from the main portion 103*a* in opposing directions. The sear engagement portion 103*b* has a cam surface 103*e* configured to selectively engage with the bolt pin arm 112. The ticker arm 103*d* extends from the main portion 103*a* in a direction substantially perpendicular to the sear engagement portion 103*b* and the actuation member engagement portion 103*c*.

As will be described, as force is applied to the trigger actuation member 120, the trigger 102 and the ticker 103 rotate in unison about the trigger pivot pin 160. Once the trigger fires and the sear 108 is released, motion of the sear 108 will cause the ticker to rotate about the ticker pivot pin 166, while motion of the trigger 102 about the trigger pivot pin 160 is inhibited by the trigger stop arm 122.

The spring 104 is coupled between a distal end of the ticker arm 103*d* and the trigger pull-weight adjustment mechanism 106. When the sear 108 is engaged by the bolt of the bolt-action firearm, it is biased to rotate about a sear pivot pin 164. Conversely, the spring 104 is configured to bias the trigger 102 and the ticker 103 to rotate in an opposite direction about the trigger pivot pin 160. These forces bias the sear 108 and the sear engagement portion 103*b* of the ticker 103 to trap the roller 114 there between. The force required to overcome the bias of the spring 104 and release the sear 108 is the pull weight of the trigger device 100.

The trigger pull-weight adjustment mechanism 106 comprises a feedback member, and a threaded wedge screw. The feedback member comprises a plurality of wedge shaped projections spaced about its surface. A first end of the threaded wedge screw is generally shaped to be complementary to the wedge shaped projections on the feedback member. A second end of the threaded wedge screw comprises a socket configured to receive a tool. For example, the socket can be a hexagonal socket and the tool can be an Allen key, hex key, screwdriver, or the like. Movement of the pull-weight adjustment mechanism 106 causes the trigger biasing spring 104 to compress or expand, thereby modifying the pull-weight of the trigger device 100. The trigger pull-weight adjustment mechanism 106 is described in greater detail in U.S. Pat. No. 9,752,841.

The bolt pin arm 112 is rotationally coupled proximal a first end to a bolt pin arm pivot pin 162. The bolt pin arm 112 comprises a cam projection 112*a* proximal the first end. The cam projection 112*a* is shaped and configured to selectively interface with the cam surface 103*e* of the ticker 103. A second end 112*b* of the bolt pin arm 112, distal to the first end, is configured to be coupled with the bolt pin 110. The bolt pin arm 112 further comprises an over travel stop 112*c* configured to selectively engage with the trigger stop interface 122*a*. In an embodiment, the over travel stop 112*c* is a protrusion that extends laterally from the bolt pin arm 112.

The bolt pin 110 comprises a recess 110*a* configured to receive and engage the second end 112*b* of the bolt pin arm 112. Thus, moving the bolt pin 110 will correspondingly move the bolt pin arm 112, and vice versa. The bolt pin 110 is movable between a bolt open position, a bolt closed position, and a bolt release position. The bolt open position is the most extended position of the bolt pin 110. The bolt release position is the most contracted position of the bolt pin 110. In the bolt closed position, the bolt pin arm 112 is positioned so that the over travel stop 112*c* is within the travel path P of the trigger stop interface 122*a*. In the bolt open position, the bolt pin arm 112 is moved so that the over travel stop 112*c* is outside of the travel path P of the trigger stop interface 122*a*.

In the present embodiment, the bolt pin 110 is biased by a biasing member (not shown) in the bolt open position. When the trigger device 100 is assembled in a bolt-action firearm, closing the bolt engages the bolt pin 110 and moves it to the bolt closed position. When the bolt is in the bolt open position, the bolt pin 110 can be moved to the bolt release position by actuating the trigger 102 as will be described.

Referring to FIG. 1, the trigger device 100 is shown in a loaded configuration. In the loaded configuration, the bolt is closed, biasing the bolt stop 110 in the bolt closed position. Accordingly, the over travel stop 112*c* is within the path of travel P of the trigger stop interface 122*a*. The roller 114 is trapped between the sear 108 and the sear engagement portion 103*b* of the ticker 103. The biasing force of the spring 104 maintains an engagement between the trigger engagement portion 103*c* of the ticker 103 and the main portion 120*b* of the trigger 102. The trigger device 100 is ready to be fired.

Figure 2:
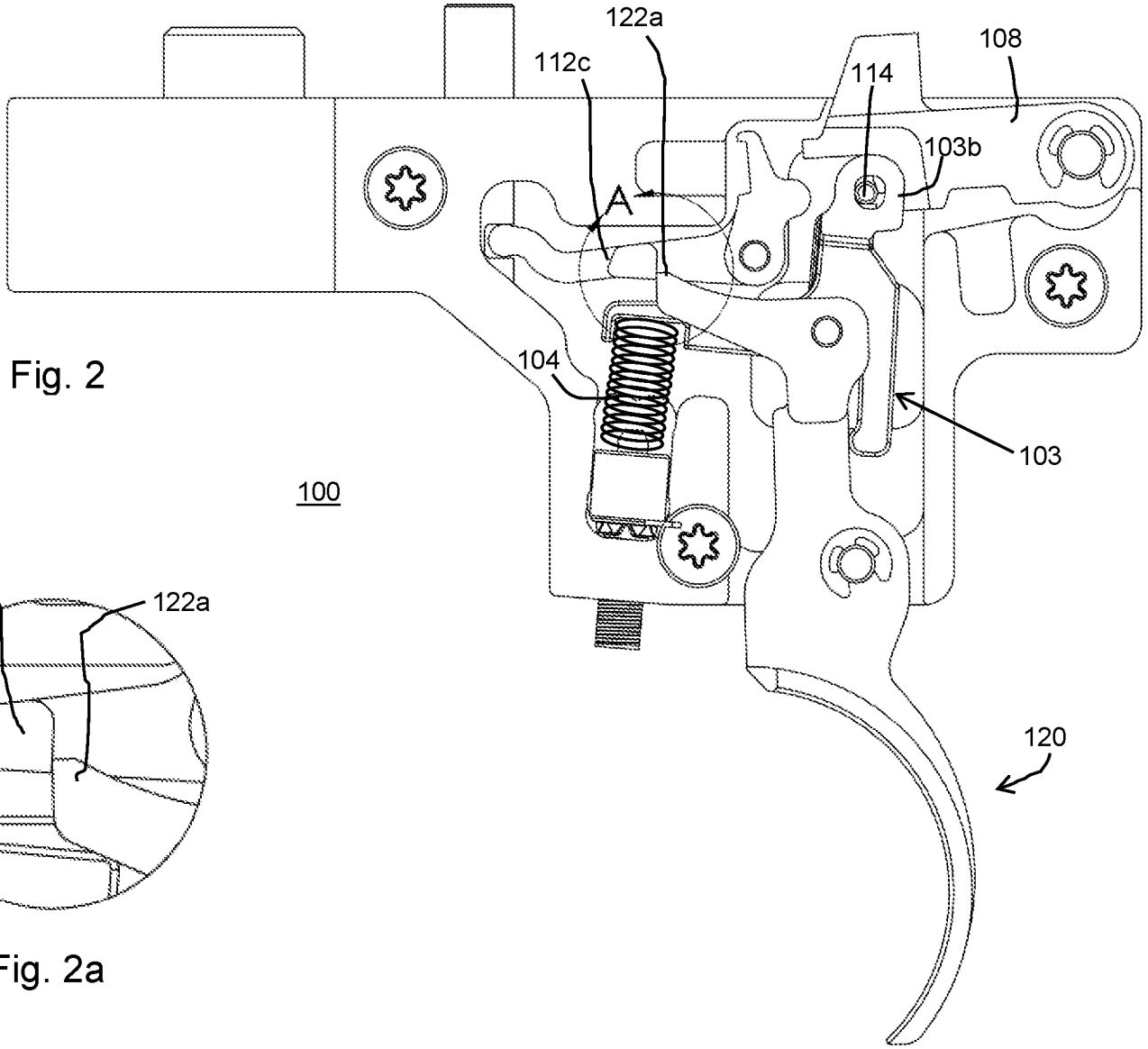
FIG. 2 is a cross-sectional view of the trigger device in a fired configuration.
Figure 2A:
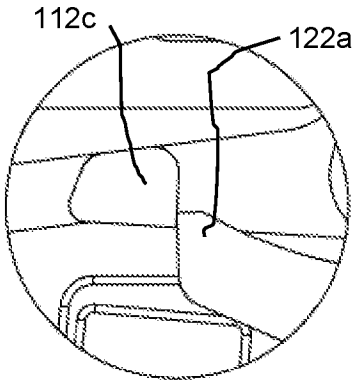
FIG. 2*a* is an enlarged view illustrating a portion of a bolt pin arm engaging a portion of a trigger.

As pressure is applied to the trigger actuation member 120, the trigger 102 and the ticker 103 rotate about the trigger pivot pin 160 and the sear engagement portion 103*b* of the ticker 103 begins to disengage from the sear 108, freeing the roller 114. Referring to FIG. 2, the trigger device 100 is shown in a fired configuration. In the fired configuration, sufficient force has been applied to the trigger actuation member 120 to overcome the biasing force of the spring 104. Accordingly, the sear engagement portion 103*b* of the ticker 103 has disengaged from the sear 108, allowing the roller 114 to translate and release the sear 108. In order to provide little or no perceptible over travel, the trigger stop interface 122*a* is configured to engage the over travel stop 112*c* at a minimal distance past the point at which the sear 108 begins to release, referred to as the break. Consideration of manufacturing tolerances should be taking into consideration, as the trigger device 100 will not fire if the over travel stop 112*c* engages the trigger 102 before the break. The engagement between the trigger stop interface 122*a* and the over travel stop 112*c* is illustrated in an enlarged view in FIG. 2*a*. Thus, the trigger 102 is inhibited from further continued movement.

Although not visible in the figures, the surface of the sear 108 that interfaces with the roller 114 is sloped. Accordingly, as the sear 108 continues to release, a horizontal force continues to be applied to the ticker 103. Since the trigger 102 is inhibited from moving further by the over travel stop 112*c*, the ticker 103 begins to rotate about the ticker pivot pin 166, as shown in FIG. 3. FIG. 3*a* shows an enlarged view of the continued engagement between the trigger stop interface 122*a* and the over travel stop 112*c*. FIG. 3*b* shows an enlarged view of the trigger engagement portion 103*c* of the ticker 103. As illustrated, rotation of the ticker 103 by the sear 108 causes the trigger engagement portion 103*c* to disengage from the trigger 102.

As described above, in this embodiment the over travel stop 112*c* is positioned to provide little or no perceptible over travel of the trigger 102 after the break. However, some users may prefer some level of over travel. Accordingly, in an alternative embodiment, the over travel stop is positioned to allow an acceptable amount of travel of the trigger past the break before the trigger stop interface 122*a* engages the over travel stop 112*c*. As will be appreciated, what is considered to be acceptable is subjective and can be determined upon design of the trigger device 100. In this embodiment, the ticker 103 may not need to rotate at all about the ticker pivot pin 166. This will depend on whether the over travel distance provides sufficient disengagement of the sear engagement portion 103*a* of the ticker from the sear 108 to allow the sear to completely release. In yet an alternate embodiment, the over travel stop 112*c* is adjustably positioned on the bolt pin arm 112. Preferably, adjustability of the over travel stop 112*c* may be limited at one end so that it cannot be positioned to prevent the trigger 102 from firing the trigger device 100. Further, the adjustability of the over travel stop 112*c* may be limited the other end to provide a maximum over travel amount.

Figures 4, 4A:
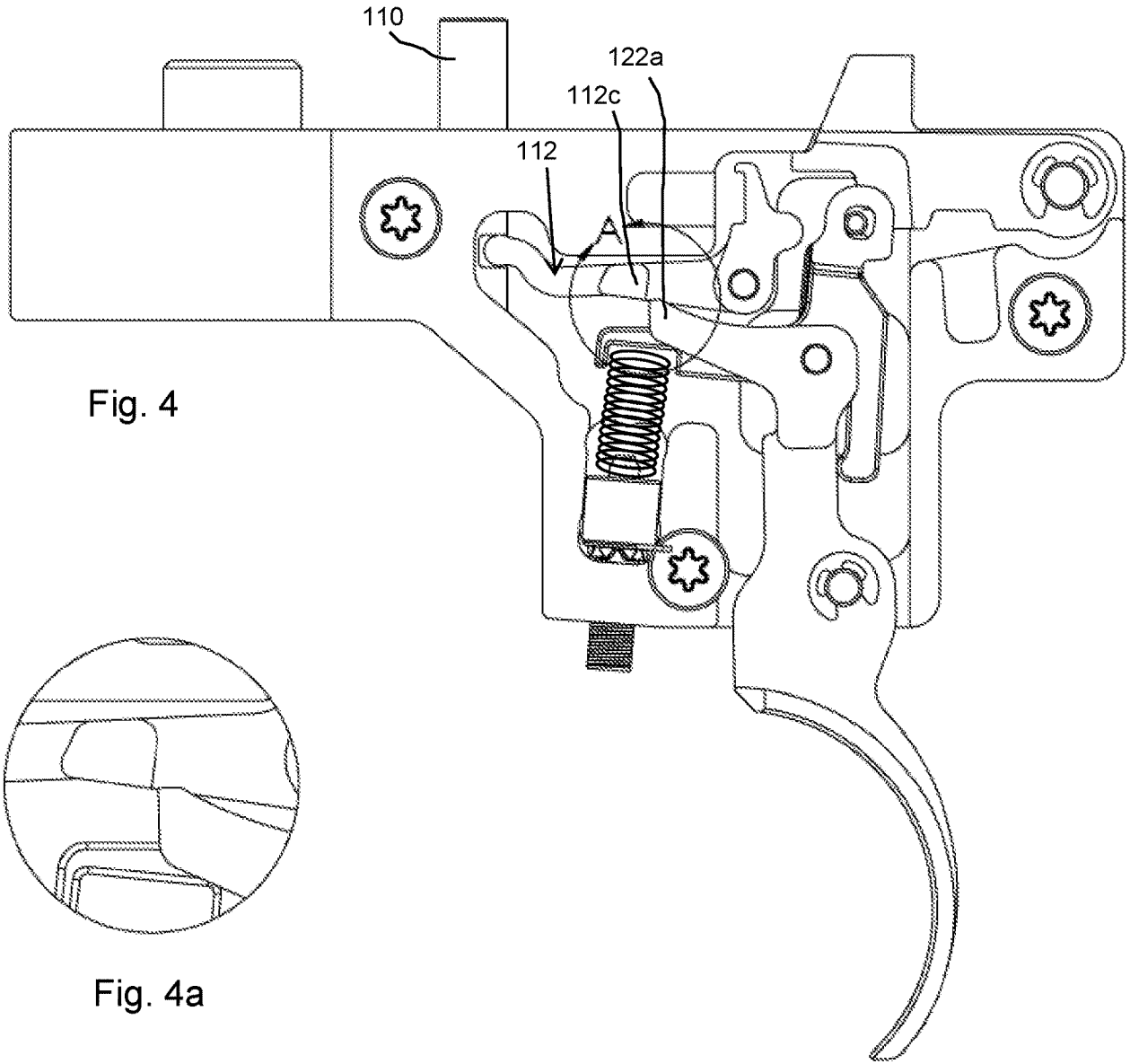
FIG. 4 is a cross-sectional view of the trigger device in a bolt open configuration.
FIG. 4*a* is an enlarged view illustrating the bolt pin arm missing the trigger.
Figure 5:
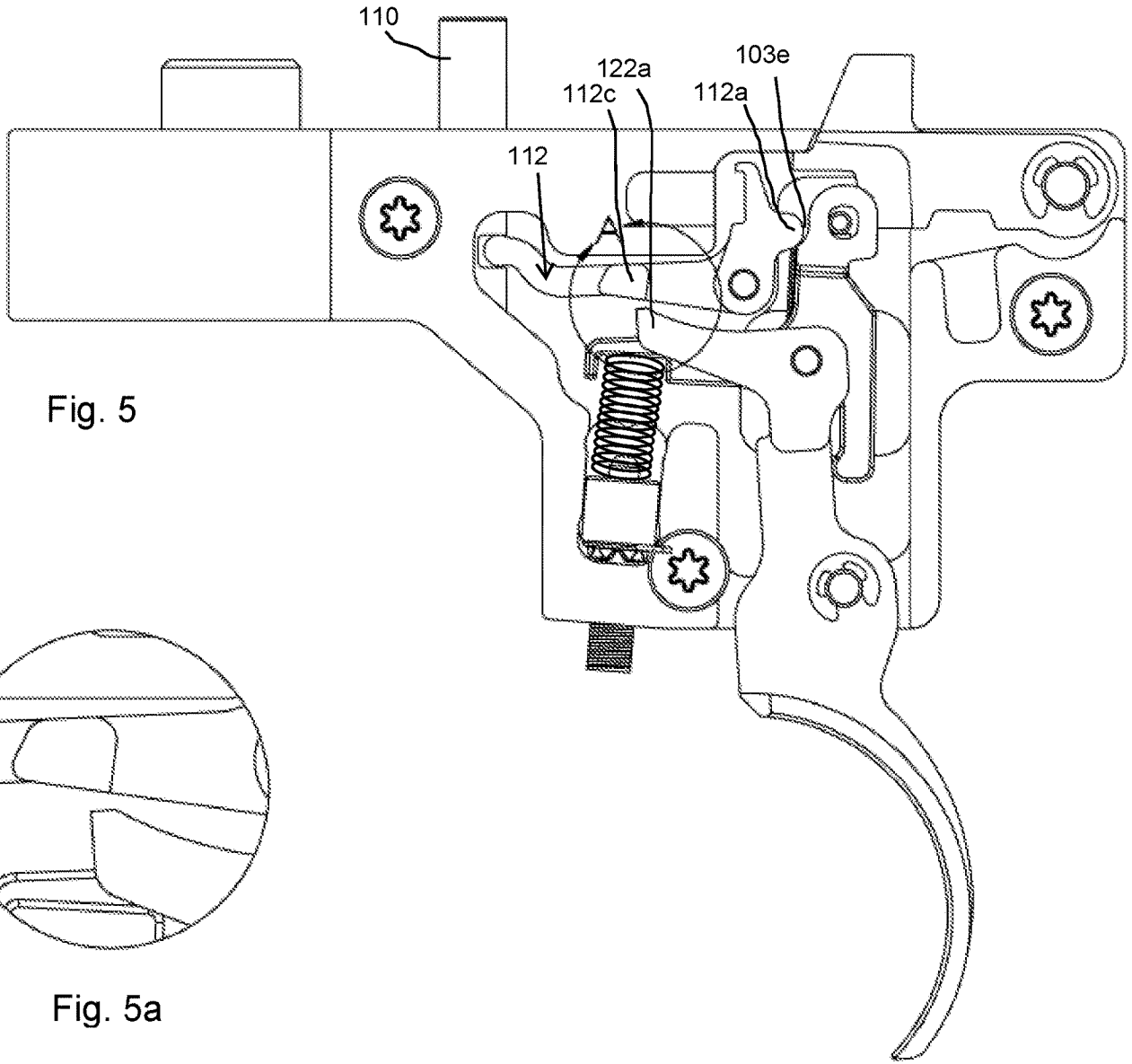
FIG. 5 is a cross-sectional view of the trigger device in a bolt release pre-engagement configuration.
Figure 5A:
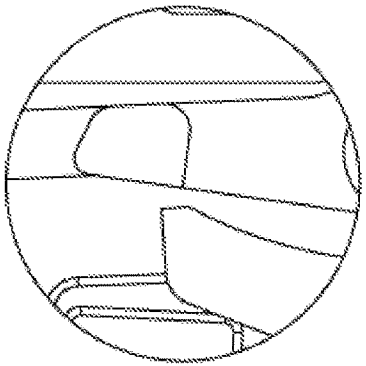
FIG. 5*a* is an enlarged view illustrating the bolt pin arm missing the trigger.

Referring to FIGS. 4 and 5, the trigger device 100 is shown in a bolt open configuration. In the bolt open configuration, the bolt assembly is open biasing the bolt pin 110 in the bolt open position. Accordingly, the bolt pin arm 112 is raised so that the over travel stop 112*c* is outside of the path of travel of the trigger stop interface 122*a*. Additionally, as is standard in the art, when the bolt assembly is open the sear 108 is inhibited from releasing. As shown in FIG. 5, further pressure is applied to the trigger 102 and the trigger 102 has moved to a cam engagement point. At the cam engagement point, the cam surface 103*e* of the ticker 103 engages the cam projection 112*a* of the bolt pin arm 112. As shown in FIG. 5*a*, at the cam engagement point the trigger stop interface 122*a* has bypassed the over travel stop 112*c*.

Figures 6, 6A:
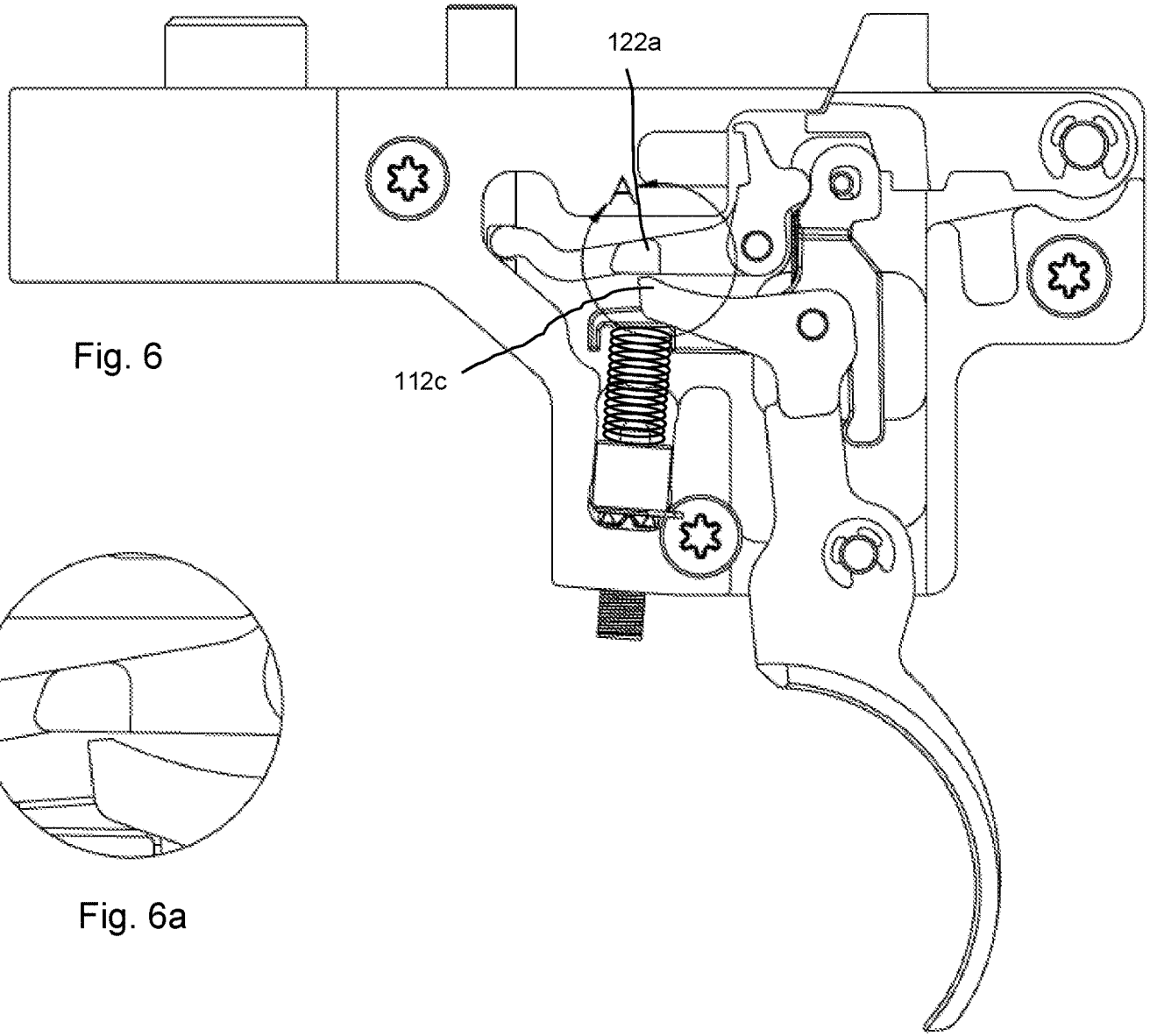
FIG. 6 is a cross-sectional view of the trigger device in a bolt release configuration.
FIG. 6*a* is an enlarged view illustrating the bolt pin arm missing the trigger.

Further movement of the trigger 102 causes the cam surface 103*e* to slidingly engage the cam projection 112*a*. Engagement of the cam surface 103*e* with the cam projection 112*a* causes the bolt pin arm 112 to rotate about the bolt pin arm pivot pin 162. Rotation of the bolt pin arm 112 causes the bolt pin 110 to contract toward the bolt release position. Referring to FIG. 6, the trigger device 100 is shown in a bolt release configuration. In the bolt release configuration, pressure on the trigger 102 is biasing the bolt pin 110 in the bolt release position. As shown in FIG. 6*a*, in the bolt release configuration the trigger stop interface 122*a* has bypassed the over travel stop 112*c*. At this point, the bolt pin 110 has been sufficient contracted that the bolt can be coupled to or decoupled from the firearm.

Accordingly, it will be appreciated that the invention described herein provides a trigger device, that that is used to release a bolt assembly from a firearm, with an over travel stop. Although the description has been made with reference to specific embodiments, those skilled in the art will appreciate that modifications can be made thereto. Thus, the scope of the claims should not be limited by the preferred embodiments set forth in the examples but should be given the broadest interpretation consistent with the description as a whole.

What is claimed is:

1. A trigger device comprising:

a housing;

a trigger rotatably coupled in the housing via a trigger pivot pin, the trigger comprising a trigger stop arm;

a bolt pin moveable between a bolt open position and a bolt closed position in response to positioning of a bolt, a bolt pin arm rotatably coupled proximal one end to the housing and at another end to the bolt pin, the bolt pin arm comprising an over travel stop configured to selectively engage with the trigger stop arm;

wherein:

in the bolt closed position, the over travel stop is positioned within a travel path of the trigger stop arm; and in the bolt open position, the over travel stop is positioned outside of the travel path of the trigger stop arm.

2. The trigger device of claim 1, further comprising a ticker coupled to the trigger, wherein the ticker comprises a cam surface and the bolt pin arm comprises a cam protrusion proximal the one end, the cam protrusion configured to engage the cam surface.

3. The trigger device of claim 2, wherein in the bolt open position:

the trigger stop arm is configured to bypass the over travel stop;

the ticker is configured to rotate the bolt pin arm by engagement of the cam surface with the cam protrusion; and the bolt pin arm is configured to move the bolt pin from the bolt open position to a bolt release position.

4. The trigger device of claim 1, wherein the over travel stop is positioned to inhibit movement of the trigger immediately following a break to provide minimal over travel.

5. The trigger device of claim 1, wherein the over travel stop is positioned to inhibit movement of the trigger at a point beyond a break to provide an acceptable amount over travel.

6. The trigger device of claim 1, wherein the trigger stop arm comprises a trigger stop interface and the over travel stop is configured to interface with trigger stop interface.

7. The trigger device of claim 2, wherein the ticker is rotatably coupled with the trigger at a ticker pivot pin and configured to rotate about the ticker pivot pin when the trigger stop arm engages the over travel stop.

8. The trigger device of claim 1, the over travel stop is adjustably coupled to the bolt pin arm to provide a variable over travel distance.

* * * * *